166-307
1/18/83 XR 4,368,922 SR

United States Patent [19]

Hemphill et al.

[11] 4,368,922

[45] Jan. 18, 1983

[54] METHOD FOR SOLUTION MINING OF COMPLEX CARBONACEOUS MATERIALS

[75] Inventors: Adley W. Hemphill, Baltimore; Joseph T. Lundquist, Jr., Columbia; Carl V. McDaniel, Laurel, all of Md.

[73] Assignee: W. R. Grace & Co., New York, N.Y.

[21] Appl. No.: 212,215

[22] Filed: Dec. 2, 1980

[51] Int. Cl.[3] ..... E21B 43/28

[52] U.S. Cl. ..... 299/5; 166/307

[58] Field of Search ..... 299/4, 5; 175/64; 166/307; 44/1 R, 15 R; 562/407

[56] References Cited

U.S. PATENT DOCUMENTS

| | | | |
|---|---|---|---|
| 3,850,477 | 11/1974 | Aldrich et al. | 299/5 |
| 3,990,513 | 11/1976 | Perch | 175/64 X |
| 4,032,193 | 6/1977 | Drinkard et al. | 175/64 X |

*Primary Examiner*—Ernest R. Purser

*Attorney, Agent, or Firm*—Michael J. McGreal; William W. McDowell, Jr.

[57] ABSTRACT

Underground coal is mined by sinking a hole into the coal, passing a coal solvent to the coal, and recovering a coal solution and/or dispersion products from the resulting solution or suspension.

6 Claims, 1 Drawing Figure

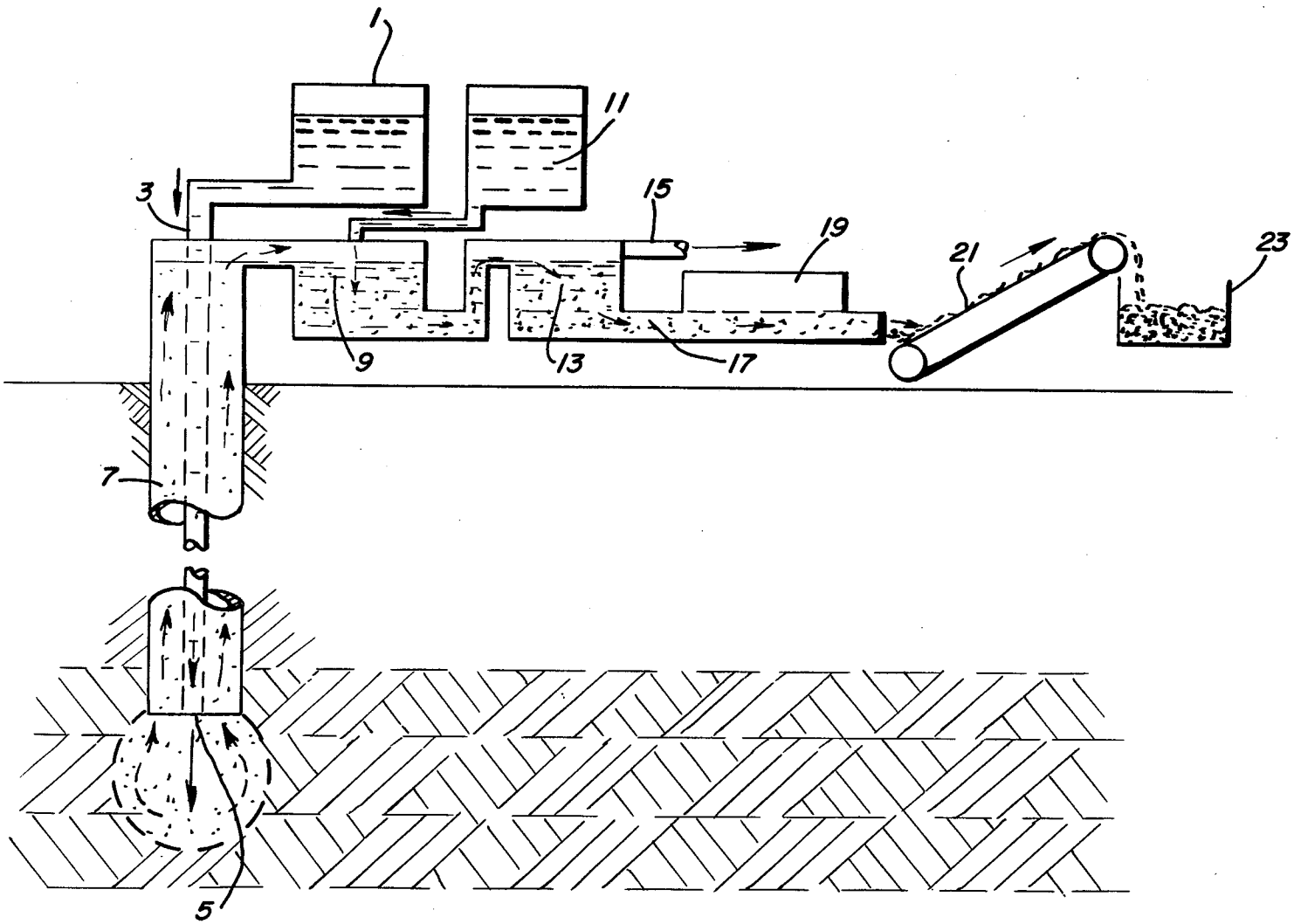
23
21
19
17
15
11
13
1
9
3
7
5

METHOD FOR SOLUTION MINING OF COMPLEX CARBONACEOUS MATERIALS

SUMMARY OF THE INVENTION

Underground formations of coal are "mined" using a solvent that at least partly dissolves or disperses the coal. To bring the solvent into contact with the coal, a hole is drilled using, e.g., conventional water well or oil well drilling techniques. A pipe is run down into the hole and coal solvent is passed down through the pipe so as to bring the solvent in good working contact with the coal. After dissolving the coal, the liquid is brought back up to the surface, via either the same or different hole(s), and processed further to recover either coal solution or dispersion products.

"COAL"

As used herein, the term coal is used in its conventional sense and includes anthracite, bituminous, subbituminous, lignite, and the like.

COAL SOLVENT

Our preferred solvent consists of (parts by volume), 500 water, 100 20% NaOH aqueous solution, and 35 parts of 30 wt.% aqueous $H_2O_2$ solution. This solution is used in the examples herein. The use of this solution is not critical, however, since actually there are a number of solutions known to dissolve coal. These include, for example, caustic, caustic/oxygen, caustic/air, sodium hypochlorite; potassium permanganate, potassium dichromate, and others.

Furthermore, the solution need not be alkaline, since it is well known that nitric acid will dissolve coal in goodly portion, with the formation of soluble products. Accordingly when the term "coal solvent" is used in this specification and claims, it is intended to include any of the solutions that will at least partially dissolve coal, whether alkaline, neutral, or acidic, and whether or not heated or under pressure, and whether or not the solution effect is total. The term also includes liquids that have a decrepitating or crumbling effect on coal. Such liquids (e.g., water, methanol, and others) may have a negligible solvent action as such on coal, but act rather to loosen it from the working face as particles, and to disperse the particles.

The following U.S. patents deal with various coal solvents (and/or decrepitating agents):

U.S. Pat. No. 1,420,754, "rotted coal", in aqueous NaOH.

U.S. Pat. No. 2,242,822, coal in aqueous $NaOH/H_2O_2$. (Or, in lieu of $H_2O_2$, $KMnO_4$, $K_2Cr_2O_7$, NaOCl, $HClO_4$, $Cl_2$, $HNO_3$, or $O_2$.

U.S. Pat. No. 2,461,740, NaOH, then with $O_2$, with acid added to recover acid products.

U.S. Pat. No. 2,929,834, alkali plus air.

U.S. Pat. No. 3,153,666, $HNO_3$.

U.S. Pat. No. 3,259,650, $KMnO_4$ or $HNO_3$ or $O_2$ in alkaline solution.

U.S. Pat. No. 3,702,340, water plus $O_2$ with $NO_2$ catalyst.

U.S. Pat. No. 4,054,420, aqueous KOH+NaOH; $O_2$.

A literature reference teaches aqueous caustic plus $H_2O_2$. The dissolved products are called "ulmins." Francis et al, J. Chem. Soc., 127, 2236–45 (1925).

All of the above solvents and/or systems are contemplated for use herein.

COAL SOLUTION

"Coal solution," as the term is used herein, refers to the product made by contacting coal with coal solvent. Some coal product is actually in true solution, e.g., as complex polycyclic aromatic polycarboxylates, in ionic form. These materials are also known as "coal acids." See U.S. Pat. No. 2,929,838. U.S. Pat. No. 3,702,340 calls a similar product "humates." Under acidic conditions they tend to precipitate in the insoluble acid form. When coal is dissolved under acid conditions, e.g., with nitric acid, the product has been described as nitrohumates, soluble in acids; see U.S. Pat. No. 3,153,666.

However formed, some material may be present in colloidal suspension, rather than in true solution. And some material may be present as finely divided particles, initially in suspension, which settle out on standing.

The drawing shows a preferred embodiment for use of the invention in extracting coal from underground formations. Referring more particularly to the drawing, at 1 is shown the storage tank for coal solvent. From this vessel coal solvent exits via line 3 to the work site underground shown at 5. Conduit 7 receives coal solution and delivers it to acidification vessel 9. The latter receives acid from acid storage vessel 11. Acidification vessel 9 delivers acidified product to settling vessel 13, which delivers supernatant liquid via line 15 to a collection vessel (not shown) or to sewage. Sludge product is removed from settling vessel 13 via line 17 to the dewatering apparatus 19, which delivers dewatered sludge or residue via conveyor 21 to final collection vessel 23.

ADVANTAGES OF THE INVENTION

This invention is particularly useful in working thin seams and hard-to-mine seams. It is an excellent device for dealing with thick overburden. It can extract coal from strata that are considered very dangerous for conventional mining. Manpower requirements are much lower than for conventional mining. In its preferred function, 100% recovery of the coal is possible. This is true even though in some cases the coal solution may not dissolve all of the coal into a true solution. The reason for this is that, during the course of dissolving coal, the insoluble residue, if any, tends to be swept up into the flowing effluent in the process of recovery. The mining process also results in considerable desulfurization and denitrification, thereby reducing $SO_3$ and $NO_x$ in the stack gases when the coal product is burned.

The following examples illustrate without limiting the invention. The mining operations described were not actually performed, but indicate recommended procedures for carrying out the invention.

EXAMPLE 1

The apparatus of the drawing was used. The coal in question was a western subbituminous type of coal lying as a horizontal strata approximately 200 feet underground. It had the following composition:

| | | | |
|---|---|---|---|
| Ash | (dry basis) | 6.10 | wt. % |
| Sulfur | (dry basis) | 0.28 | wt. % |
| Volatile material | (dry basis) | 37.92 | wt. % |
| Fixed carbon | (dry basis) | 55.98 | wt. % |
| Moisture | | 14 | wt. % |
| BTU/pound | (dry basis) | 12,635 | |

A 10 inch hole was drilled into the strata using standard techniques. Into the hole were sunk two concentric pipes, the outer pipe being 9 inches in inner diameter and the inner pipe 1½ inches in inner diameter. Both pipes were of approximately the same length, except that the inner pipe was slightly withdrawn from the bottom so as to permit ready flow of the oxidizing solution at the solution site. The center pipe was equipped at its upper end with an inlet for the dissolving solution, and the outer annulus was provided with a takeup to withdraw dissolved product. Both inlet and outlet were equipped with appropriate pumps and valving. The outlet discharged into a vessel for the addition of acid, for precipitation of product from the coal solution. In this instance, 12 N HCl was added to adjust the pH to 3. This vessel was equipped with a discharge outlet at the bottom whereby the settled product was pumped to the top of a settling tank, to which could be added a flocculant such as polyacrylamide. The settling tank was equipped with an exit and pump in its lower area to remove sludge. The sludge was, of course, precipitated or undissolved coal product. This sludge conveniently proceeds to dewatering apparatus, of any commercial type, effective to lower the water content of the product to about 30% $H_2O$.

At startup, about 500 gallons of caustic oxidizing solution (our preferred solvent as above described) was run down into the work site through the central pipe, and allowed to react with the coal for a period of about 60 minutes. Following this an additional stream of caustic oxidizing solution was pumped into the central pipe at a rate of about 100 gallons per hour. This rate was effective in dissolving/breaking up the coal at the dissolution base. The working solution, after being processed in the unit steps as above described, gave a product which was filtered, washed free of dissolved salts, and dried at 80° C. in a vacuum oven. The oven-dried product was analyzed with the following results:

| | |
|---|---|
| Moisture | 2.83 wt. % |
| Ash (dry basis) | 0.57 wt. % |
| Sulfur (dry basis) | 0.30 wt. % |
| BTU/lb. (MAF[1]) | 11,428 |

[1]MAF means moisture and ash free.

Our data indicate the following materials usage and recoveries in this embodiment.

| | |
|---|---|
| Gallons of caustic/oxidant solution | 100 |
| Pounds of coal removed from working face | 600 |
| HCl consumed (100% basis) | 32 |
| Pounds of coal product recovered (Some recovered as a dispersion) | 500 |

EXAMPLE 2

SLANT DRILLING

In this example the invention was used in extracting coal from an inclined strata. This strata was at an angle of about 45° to ground level, and was about 5 feet thick. A 10 inch hole was sunk from ground level into contact with the strata and the drilling continued until the hole was at about the vertical center of the strata, (i.e., to about 200 feet below ground level), whereupon the hole was then slanted to remain in the center of the strata, using conventional drilling techniques. Extraction apparatus was then fitted over the hole, and included a flexible polyethylene pipe 1½ inches inner diameter, measured to reach down to within 2 feet of the end of the drill hole. Nine-inch ID casing was sunk into the vertical portion of the drill hole, but there was no casing beyond that. Capping the exit area of the hole was a vessel to receive effluent coal solution. Caustic/oxidizing solution was pumped down through the pipe as in Example 1 and coal solution was allowed to rise and was collected in the same collection apparatus as used in Example 2. As noted, the area beyond the casing and extending into the end of the hole in the strata contained no support. It was found that although some coal dropped from the hole surfaces into the hole, this was, in fact, an advantage and permitted faster extraction of the coal in this zone.

Yield and analysis was approximately that of Example 1.

EXAMPLE 3

FRACTURED SEAMS

In this case the invention was used on a seam of coal which was hydraulically fractured by means conventionally employed in oil formations. By fractured is meant that tiny cracks in a reticulated network exist throughout the structure, whereby fluid is in fact able to seep for considerable distances through such strata.

The strata had an overburden of about 500 feet. A 4-inch hole was drilled through this overburden down into the body of the fractured strata. A 3-inch ID casing was sunk down through the hole. This first hole served as an inlet for oxidant solution. On 500 ft. centers around this first hole were also sunk six additional holes down to the same depth as the first hole. These were each about 4 inches in diameter and were fit with casings. A manifold was arranged over the exits of each of the six secondary holes to draw off effluent. This effluent ran to the same collection apparatus as used in Example 1. The procedure of Example 1 was substantially followed. Caustic/oxidant solution was pumped through the inlet conduit under pressure. After the passage of some time, it was observed that fluid was rising in the exit manifold. This product was removed and collected, and processed as in Example 1, with a good recovery of coal product.

In one embodiment it is desirable to recover the entire dispersion as it comes up from the working face of the coal. This dispersion is then mechanically treated (e.g., by centrifugation, filtration, or settling, and the like) to recover decripitated dispersed solids, without (at that point) treating with acid to precipitate any soluble coal product. The recovered decrepitated solids are taken as product, and the liquid is recycled to pick up more coal (in solution and/or as decrepitated solids) from the working face. Make up components (oxidant, etc.) as needed may be added to replenish the recycling solution.

We claim:

1. A method of mining coal situated as strata beneath an overburden comprising:

(a) sinking a hole from the surface through the overburden into the strata;

(b) passing a basic coal solvent down into a hole and into the strata;

(c) dissolving or suspending at least a portion of the coal into the coal solvent;

(d) removing the coal solvent to the surface;

(e) adjusting the pH of the coal solvent to a pH of about 3 to precipitate solids;

(f) adding a flocculant to cause said precipitated solids to settle; and (g) recovering the precipitated solids.

2. A method of mining coal situated as strata beneath an overburden as in claim 1, wherein the liquid portion of said coal solvent after precipitation of said solids is recycled for use as a coal solvent.

3. Method according to claim 2 in which the coal solution components are replenished.

4. Method according to claim 1 in which the coal solvent consists essentially of:

| | Parts by volume |
|---|---|
| Water | 500 |
| NaOH (20% aqueous) | 100 |
| $H_2O_2$ (30% aqueous) | 35 |

5. Method according to claim 1 in which the solids are dewatered to a water content of about 30%.

6. Method according to claim 1 in which the coal is a subbituminous coal.

* * * * *